United States Patent [19]

Wagner et al.

[11] Patent Number: 4,592,224

[45] Date of Patent: Jun. 3, 1986

[54] PROCESS AND DEVICE FOR EXTRUDING A HOLLOW SECTION

[75] Inventors: Alfred Wagner, Steisslingen; Adolf Ames, Duchtlingen, both of Fed. Rep. of Germany

[73] Assignee: Swiss Aluminium Ltd., Chippis, Switzerland

[21] Appl. No.: 563,310

[22] Filed: Dec. 20, 1983

[30] Foreign Application Priority Data

Dec. 24, 1982 [DE] Fed. Rep. of Germany ..... 3247977

[51] Int. Cl.[4] ..... B21C 23/08; B21C 27/00; B21C 25/02

[52] U.S. Cl. ..... 72/264; 72/272; 72/467; 72/478

[58] Field of Search ..... 72/263–265, 72/253.1, 272, 266, 478, 482, 267, 467, 468

[56] References Cited

U.S. PATENT DOCUMENTS

| | | | |
|---|---|---|---|
| 682,360 | 9/1901 | Keithley | 72/266 |
| 1,854,411 | 4/1932 | Leighton | 72/260 |
| 2,225,902 | 12/1940 | Cartwright | 72/266 |
| 2,389,876 | 11/1945 | Sequin | 72/272 |
| 2,860,775 | 11/1958 | Brauchler | 72/272 |
| 2,893,553 | 7/1959 | Kreidler | 72/265 |
| 3,150,773 | 9/1964 | Riehter | 72/273.5 |
| 3,355,927 | 12/1967 | Sibler | 72/261 |
| 3,611,778 | 10/1971 | Hubert | 72/272 |
| 3,739,620 | 6/1973 | Jesmore | 72/260 |
| 4,052,877 | 10/1977 | Zilges | 72/273.5 |
| 4,084,422 | 4/1978 | Zilges et al. | 72/273.5 |
| 4,332,156 | 6/1982 | Broodman | 72/272 |

FOREIGN PATENT DOCUMENTS

| | | | |
|---|---|---|---|
| 2814525 | 10/1978 | Fed. Rep. of Germany | 72/272 |
| 68524 | 6/1981 | Japan | 72/266 |
| 682303 | 8/1979 | U.S.S.R. | 72/253.1 |
| 820961 | 4/1981 | U.S.S.R. | 72/253.1 |
| 893373 | 1/1982 | U.S.S.R. | 72/253.1 |

*Primary Examiner*—Lowell A. Larson
*Attorney, Agent, or Firm*—Bachman & LaPointe

[57] ABSTRACT

A process for extruding a metal billet, in particular a light metal billet in an extrusion container, into the form of a hollow section through a shape-giving orifice in a die having a mandrel which determines the inner contour of the hollow section, and a device with stem for extruding should be designed such that it is possible to produce flanged tubes with integral flange in one piece. This object is achieved by way of the invention in that in the extrusion of the hollow section an integral flange is produced, preferably at the end of the extrusion stroke. In the extrusion press suitable for this purpose a shaping recess is provided, with respect to the extrusion direction, immediately before the orifice of the die, the radial dimension of which is greater than the width of the die orifice. As such it should be possible to separate the die radial to the extrusion direction into at least two parts.

11 Claims, 7 Drawing Figures

6
5
4
9
E
E
14
54
50
e
18
18
51
52
40
36
36
36
h
i
i
41
43
42
20
19
35
46
45
37
35
40
43
20
19

PROCESS AND DEVICE FOR EXTRUDING A HOLLOW SECTION

BACKGROUND OF THE INVENTION

The invention relates to a process for extruding a billet to a hollow section, in particular a light metal billet which is situated in a container and is extruded through the shape-giving opening or orifice of a die which accommodates a mandrel determining the internal contour of the hollow section. Also within the scope of the invention is a device for extruding with an extrusion stem.

A device of this kind and a corresponding process are described in the U.S. Pat. No. 3,240,047, and namely employing a weld-chamber type die which supports a plurality of fixed mandrels on a bridging part of the die, the shaft of which is surrounded at a distance therefrom by a die ring.

This die is intended for the production of tubes which feature so-called extrusion welds running in the direction of extrusion and therefore exhibit a non-uniform structure when viewed in cross-section.

Applications exist for tubes or the like hollow sections which must exhibit not only a seamless wall body, but should also feature a flange at the end of the tube—and this with as little change in structure as possible. Such an application exists for example in the form of containers for uranium separation plants; these containers comprise a tube body with flange at one end. The latter part is usually welded-on and subsequently machined etc.

In view of the above, the object of the present invention is to produce, in one piece and as economically as possible, a hollow section with integral flange at the end.

SUMMARY OF THE INVENTION

The foregoing object is achieved by way of the invention in that during extrusion a flange, integral with the hollow section and preferably at the end of extrusion, is formed in a shaping recess from the part of the billet remaining after extrusion of the hollow section. Subsequently, according to a further feature of the invention, it should be possible to remove the hollow section, downstream of the flange with respect to the direction of extrusion, from the die in the extrusion direction.

As a result a seamless, one-piece, integral tube with flange, preferably of light metal, is obtained. The same is able to satisfy increased strength requirements and is able to be produced in a single step, at the same time avoiding formation of that part of the billet which remains and has to be sheared off after extrusion of the billet.

Within the scope of the invention is a device of the above mentioned kind in which a shaping recess is provided at the die, immediately before the die, with respect to the extrusion direction, the radial dimension of the said recess being greater than the cross-sectional width of the same chamber, in which the flange, projecting out beyond the sidewall of the hollow section, is formed out of the extruded matrix. The die comprises at least two parts wherein the shape-giving orifice is in one of the parts and the shaping recess is in the other of the parts and wherein the parts are removable from one another.

It has been found particularly favorable to provide the flange-shaping recess as an integral part of the die at the end facing the billet container, so that the die shapes both the hollow section and the integral flange in its full height. It is, however, also possible to arrange as an extension to this recess another recess, running in the opposite direction to the extrusion direction, in the abutting face of the container. This is particularly appropriate if flanges of greater height are to be produced.

The removal of the finished hollow section, with flange, from the extrusion press takes place, according to the invention, in the direction of extrusion, for which reason the die is divided axially in at least two parts, the surfaces delimiting the shape-giving cross-section, mainly part ring-shaped, being movable with respect to each other with the die parts. The separate surfaces delimiting the shape-giving cross-section can be moved apart to form a gap which is larger than the corresponding dimension of the flange, so that the latter can be removed through the tooling or die.

If the flange is multi-colored, then the separating faces of the die parts, and if necessary the parts of a die holder containing these die parts, run diagonally across the cross section of the die, that is, through two corners as viewed in cross section. These corners preferably provide vertical separating faces which permit the die parts to be moved sideways.

In general, according to the invention, each die part resides in a corresponding part of a multi-piece die holder.

During extrusion the axially divided die is held together by a surrounding die ring which, in the scope of the present invention either represents a special machine part or is formed by the billet container.

For this purpose, it has been found useful to taper the end of the die close to the container or to provide it with a blunted cone-shaped surface, onto which the die ring or a container featuring a corresponding recess is pushed. The die ring or container is sufficiently thick and strong to accommodate all the radial forces arising there during extrusion.

An advantage of the conical surfaces between die and billet container or die ring is that the axial connection is easy to make and break again.

As the contours of the shaping recess determine the shape of the flange, it is also possible for example to provide this with ring-shaped ribs or the like, if appropriate grooves are present in the floor of the chamber.

In all, thanks to the invention, it is now possible to extrude flanged pipes of aluminum which, up to now, has not been possible in the simple manner described above.

BRIEF DESCRIPTION OF THE DRAWINGS

Further advantages, features and details of the invention are revealed in the following description of preferred exemplified embodiments and with the help of the drawings wherein.

DETAILED DESCRIPTION

Figure 1:
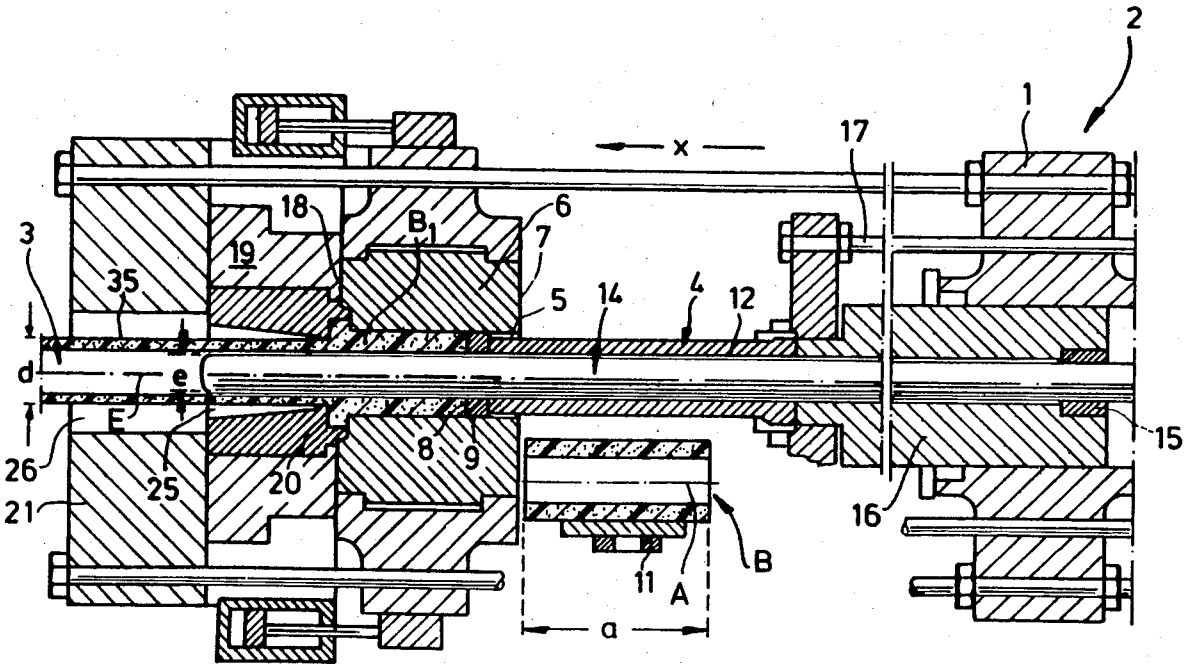
FIG. 1: Is a horizontal, longitudinal cross-section through an extrusion press during the production of a hollow section.
Figure 2:
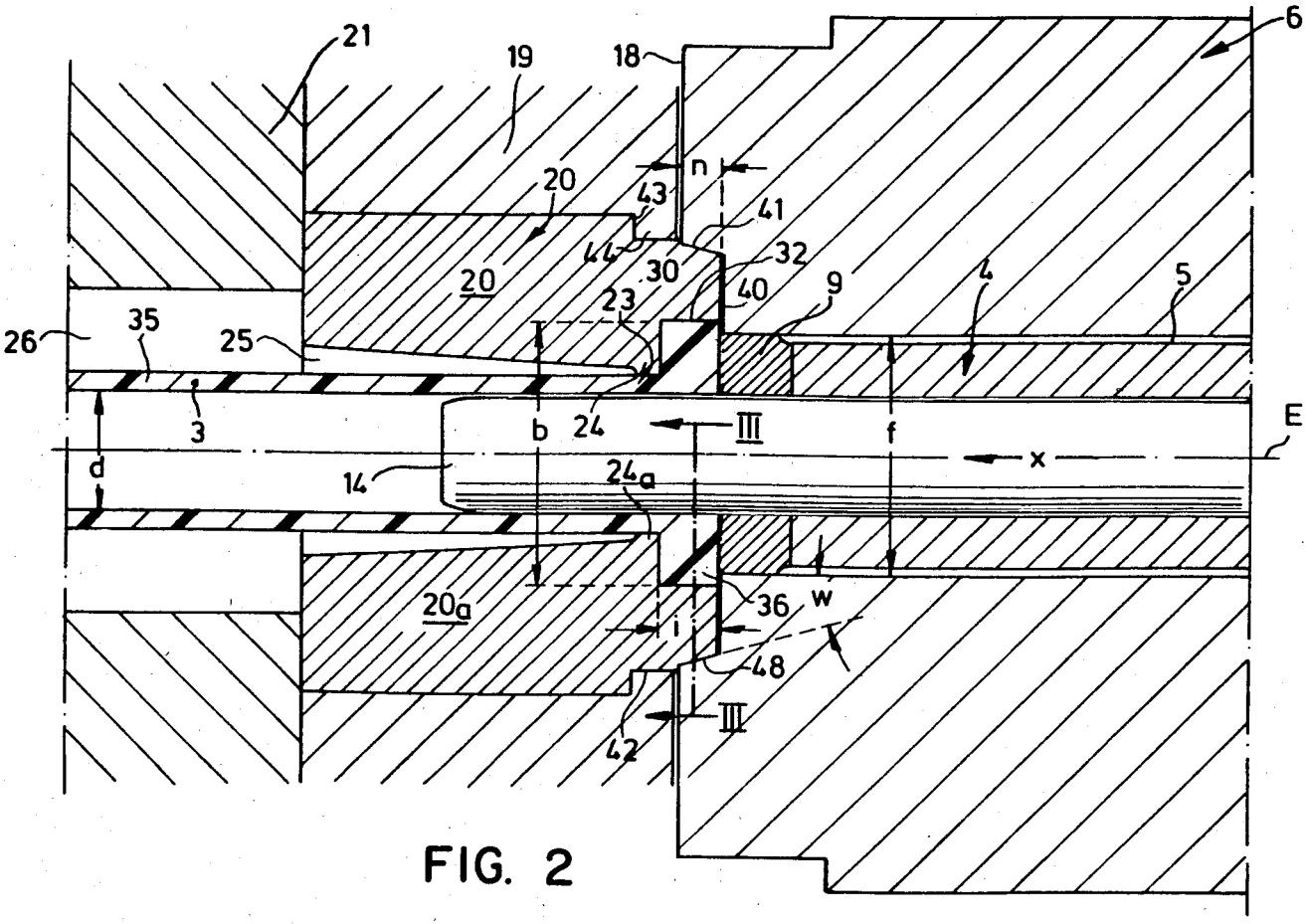
FIG. 2: Is an enlarged view of part of FIG. 1.

As shown in FIG. 1 a hollow extrusion stem 4 projects from the main cylinder 1 of an extrusion press 2 into a bore 5 in a container 6 for the purpose of producing hollow sections 3 of diameter d. The maximum distance a between the container front 7 on the side of the main cylinder 1 and the compression face 8 of a dummy block 9 on extrusion stem 4 is, when stem 4 is in the non-operating position—not shown here—such that a hollow billet B of light metal can be placed in front of the said compression face 8 by means of a billet loader 11. When the billet axis A is in line with the axis E of the extrusion press, the billet B is pushed by the stem 4 in direction of extrusion x into container 6.

Running in the press axis E through the bore 12 of the hollow stem 4 and hollow billet B is a horizontal mandrel 14 of outer diameter e which rests, such that it can be displaced, in bearings 15 of a piston 16 of main cylinder 1. The piston 16 is actuated by piston rods 17.

Residing in a die holder 19 at the container face 18 remote from the main cylinder 1 is a die 20 which is the shape-giving tool. The die holder 19 is braced against a platen 21 at the exit end of the press.

Figure 5:
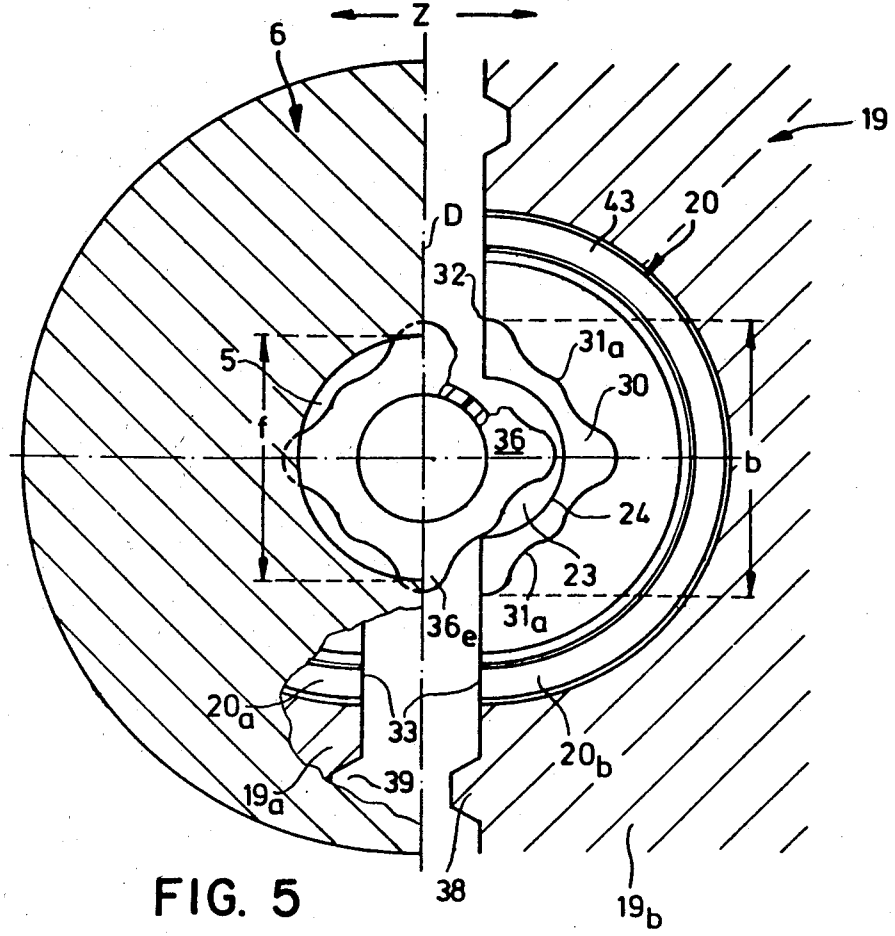
FIG. 5: Is a partial cross-section through FIG. 4 along line V—V.
Figure 4:
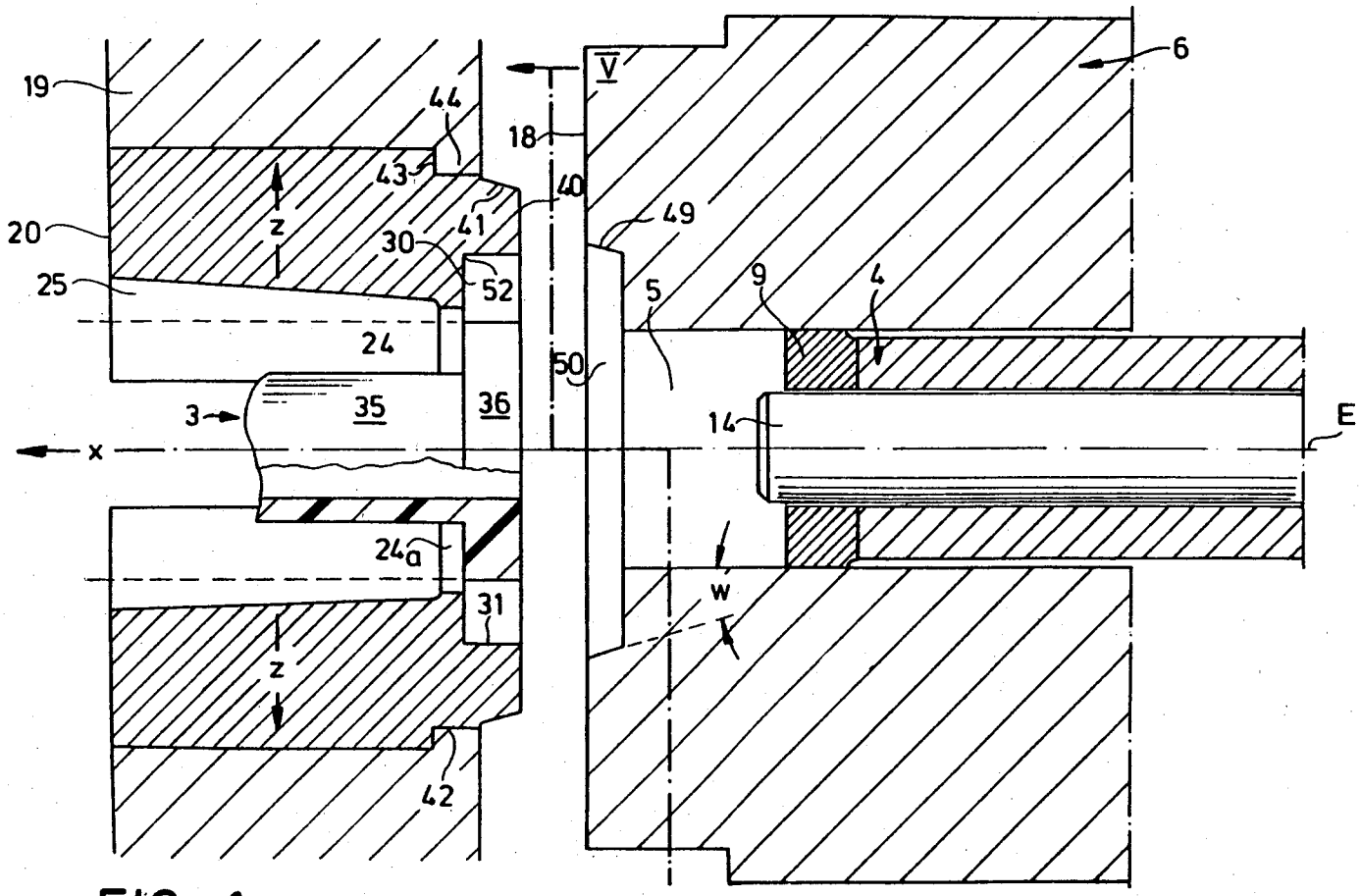
FIG. 4: Is a view of part of the extrusion press shown in FIG. 2 but in another operating position.

As can be seen particularly well in FIGS. 4 and 5, the die holder 19 and die 20 are divided at diameter D of the circular shaping section or die opening 23, and can be separated by moving these in the radial direction z; two ring halves 24,24*a* delimit the die opening 23. An exit channel 25 runs conically outwards from these ring halves to an opening 26 in the platen 21.

Figure 3:
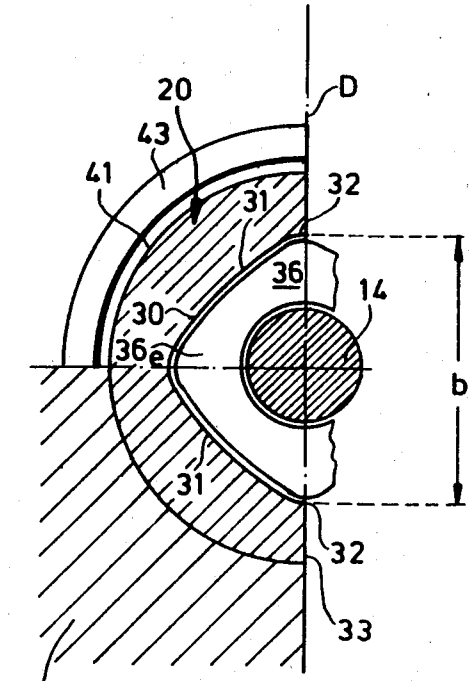
FIG. 3: Is a partial cross-section through FIG. 2 along line III—III.

Before the die opening 23—in terms of the extrusion direction x—is a recess 30 in die 20, the largest width b of which recess 30 is greater than the diameter f of the container bore 5. The sidewalls 31 of this recess 30 delimit, as viewed in FIG. 3, an almost square cross section, and are in one version wavy (31*a* in FIG. 5). The line of separation, diameter D, forms a diagonal through two opposite lying corners 32 which lie therefore at the separating faces 33 of the die 20. Aligned with these are the separating faces 34 of the multi-component die holder 19. The separating faces 34 of the die holder parts 19*a*,19*b* feature in FIG. 5 centering strips 38 on the one side and corresponding centering grooves 39 on the other to accommodate strips 38 in the closed position.

This recess 30 accepts a part of the matrix B, resulting from billet B which is shaped into hollow section 3 during the actual extrusion process. This comprises then a tube part 35, the inner contour of which is determined by the mandrel 14 while the outer contour is determined by the ring halves 24,24*a* of the die opening 23, and a flange 36 of height i formed onto the tube part 35 as one whole piece. This flange 36 is created out of the residual part of the matrix $B_1$. The distance of this flange 36 from the sidewalls 31 of recess 30 is shown exaggerated in FIG. 3.

The flange 36, after uninterrupted extrusion of billet B and separation of die halves 20*a* and 20*b* (FIG. 5) can be withdrawn between these in the direction of extrusion. Before removing the extruded section 3, the mandrel 14 is pulled back, whereby flange corners 36*e* are braced against the face 18 of the container.

In order to ensure that the separating faces 33 of die halves 20*a*, 20*b* lie against each other during extrusion, die 20 increases in size from face 40 in the direction of extrusion x to form a blunted cone-shaped face 41 over length n up to a ring-shaped surface 42 which is followed by a shoulder-like ring face 43; a ring-shaped rib 44 of die holder 19 rests against face 43.

When die 20 is in the closed position for extrusion, a locking wall 49 of central recess 50 in the one-piece container 6 runs approximately parallel to and encloses surface 41 on die 20 which runs at an angle w to the press axis E—for example at 15°—such as is shown particularly well in FIG. 4.

Instead of locking wall 49, the outer die face 41 on which the locking together of the die parts takes place can be enclosed in a locking ring 51 which a nose 52 of die 20 rests against and the thickness h of which corresponds at least to height i of flange 36.

Figures 6, 7:
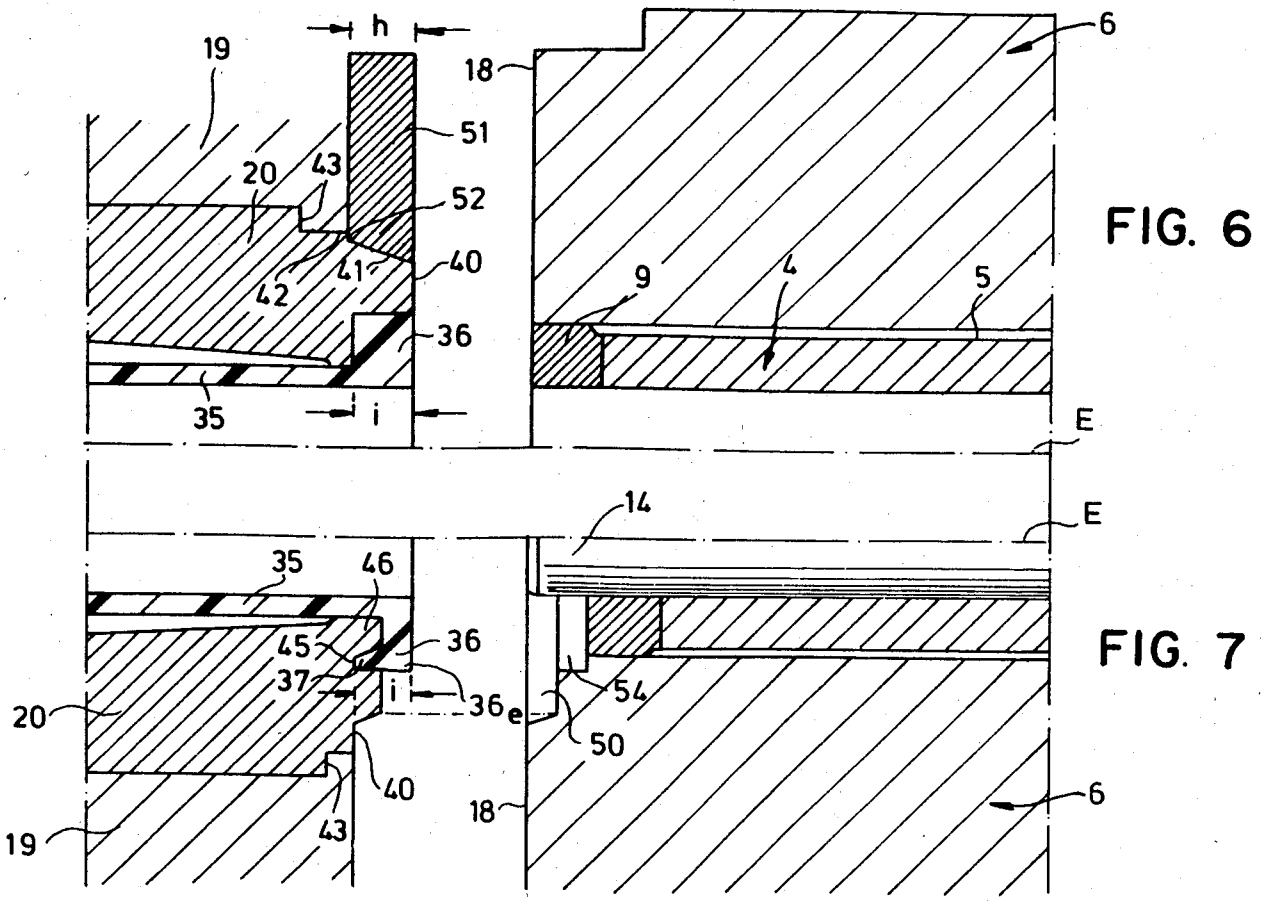
FIGS. 6,7: Is a view of part of the extrusion press shown in FIG. 2 but a different version thereof.

In an exemplified embodiment illustrated in FIG. 7—as a result of a shaping groove 45 delimited by a rib 46 on die 20—a flange 36 with peripheral rib 37 is produced, and such that the flange 36 projects out beyond the front 40 of the die 20; the outward projecting part of the flange is created in a shaping recess 54 in the face 18 of the container 6 which joins up in the extrusion direction with the central opening 50 in the container.

Thanks to this device 2 it is now possible to press—in one piece—flanged tubes 3 which can, for example, be employed as containers in centrifuges used in uranium precipitation plants. The shape of the flange, as seen in plan view, is determined by the recess 30 and can be chosen at will, likewise the diameter d of the pipe part 3. It is also left to choice, according to the given conditions, whether the usual hollow billets B are used or whether these are first heat-treated. The facility for solution treatment of the billet B is not shown in the drawings here.

The mandrel 14 can in accordance with U.S. Pat. No. 4,223,548 be of the floating kind or as a fixed part of the stem 4. It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for extruding by pressing through the shape-given orifice of a die a hollow section from a billet positioned in a bore in a container wherein the outline of the die orifice determines the outer contour of the hollow section and a mandrel determines the inner contour, comprising providing a die having a shape-giving orifice and a shaping recess upstream of the shape-giving orifice wherein the diameter of the recess is larger than the diameter of the container bore for forming a flange onto the extruded hollow section as an integral part thereof during the extrusion stroke and extruding said billet through said shape-giving orifice and into said recess such that the entire billet is pressed from said container.

2. A process according to claim 1 including removing the hollow section downstream of the flange with respect to the extrusion direction.

3. A device for extruding flanged hollow sections comprising a container having a bore, a die having a shape-giving orifice downstream of said container bore, a hollow extrusion stem for extruding a billet positioned in said container bore through said die orifice and a mandrel mounted in said hollow extrusion stem wherein the outline of the die orifice determines the outer contour of the hollow section and the mandrel the inner contour wherein said die includes a shaping recess upstream of the shape-giving orifice in the die with respect to the direction of extrusion wherein the radial dimension (b) of the recess is larger than the diameter (f) of the container bore.

4. A device according to claim 3 wherein said shaping recess is provided in the front face of the die directed towards the container.

5. A device according to claim 4 wherein the die is divided along its axis into two parts and the faces thereof which delimit the shape-giving orifice are such that they can be moved with respect to each other with the die parts, if desired it being possible to move apart these die orifice delimiting and divided faces to such an extent that a gap is formed of such a size that it is greater than the corresponding dimension (b) of the shaping recess.

6. A device according to claim 5 wherein the sidewalls of the shaping recess are multi-sided as seen in plan view, and the position of the separating faces of die parts is given by two corners of the shaping recess as seen in plan view, the separating surfaces preferably running vertically through the shape-giving orifice.

7. A device according to claim 6 wherein the parts of the die reside in a correspondingly divided, separable die holder and the die is provided with a ring which encircles the die during extrusion.

8. A device according to claim 3 wherein the die tapers conically inwards on the exterior surface thereof in the direction opposite to the extrusion direction at least in a region close to the die.

9. A device according to claim 8 wherein the conical region is inserted within a die ring which encircles the die during extrusion.

10. A device according to claim 9 wherein the container is in the form of a ring and has a recess facing the die to accommodate the conical die region, and the die ring is inclined at angle (w) of 5° to 15° to the extrusion direction.

11. A device according to claim 10 wherein grooves are provided in the floor of the shaping recess of the die and an extension recess is provided in the adjacent container face and extends in the direction opposite to the extrusion direction.

* * * * *